United States Patent [19]

Wilson

[11] 4,193,593

[45] Mar. 18, 1980

[54] ARM AND WRIST EXERCISER

[76] Inventor: Bradford W. Wilson, 1642-A Coriander, Costa Mesa, Calif. 92626

[21] Appl. No.: 809,977

[22] Filed: Jun. 27, 1977

[51] Int. Cl.[2] ..... A63B 21/00

[52] U.S. Cl. ..... 272/137; 272/142; 272/67

[58] Field of Search ..... 272/142, 143, 135, 137, 272/DIG. 4, DIG. 5

[56] References Cited

U.S. PATENT DOCUMENTS

| | | | |
|---|---|---|---|
| 967,403 | 8/1910 | Marley | 272/142 |
| 3,312,466 | 4/1967 | Melchiona | 272/137 |
| 3,343,837 | 9/1967 | Grzybowski | 272/137 |
| 4,026,548 | 5/1977 | Birdwell | 272/142 X |

*Primary Examiner*—Richard C. Pinkham
*Assistant Examiner*—William R. Browne
*Attorney, Agent, or Firm*—Gordon L. Peterson

[57] ABSTRACT

An extendable and rotatable exercising device comprising outer and inner tubes which can be manually grasped and pulled generally axially from a collapsed position to an extended position. An elongated resilient element extends through the inner tube and is attached to the opposite ends thereof. The resilient element is prestressed and acts to resiliently resist movement of the tubes from the collapsed position toward the extended position. The tubes are relatively axially rotatable to allow the wrists of the user to be exercised.

7 Claims, 5 Drawing Figures

ARM AND WRIST EXERCISER

BACKGROUND OF THE INVENTION

Various forms of exercisers are known in which the opposite ends of the exerciser are pulled apart against a resilient biasing force for the purpose of developing the arms, shoulders and chest. One such device includes one or more springs having hand grips at the opposite ends of the springs. In use, the hand grips are grasped and pulled away from each other against the resilient force of the springs.

One problem with this kind of exerciser is that the initial force required to initiate spring elongation is typically very low. Accordingly, the exerciser must be extended a very substantial distance in order for the user to feel a very substantial resistance to the pulling motion which he exerts. Thus, it is difficult or impossible to obtain high resistance to arm movements when the hands of the user are relatively close together. Even if the springs are relatively stiff, the initial force required to elongate them is not ordinarily very substantial.

SUMMARY OF THE INVENTION

The present invention overcomes the problems noted above by providing an exercising device in which it is possible to have substantial resistance to the initial pulling movement. Substantial resistance to outward pulling can be achieved with the hands of the user relatively closer together. This also permits the exerciser to be of a smaller size.

This can be accomplished, at least in part, by providing an exerciser which includes an elongated resilient element which is prestressed so that a pulling force of a predetermined magnitude must be exerted before the elongated resilient element will further elongate. In other words, the prestress requires that the pulling force be of a predetermined magnitude on the spring curve before further elongation of the resilient element is possible. In this manner, a high initial pulling force is required.

The exercising device can advantageously include outer and inner tubes. The tubes are capable of being manually grasped and pulled generally axially from a collapsed position to an extended position. The resilient element extends at least part way through the inner member and resiliently holds the tubes in the collapsed position. The resilient tube is also prestressed in the collapsed position.

In order that the resilient element can be prestressed, it is appropriately attached to one or both of the tubes. For example, the resilient element may be attached to the opposite ends of the inner tube. Alternatively, it may be attached to one end of the inner tube and the opposite end of the outer tube. In either event, the resilient element must be attached to both the inner and the outer tubes when the tubes are pulled from the collapsed position toward the extended position in order that the resilient element can resiliently resist movement of the tubes from the collapsed position to the extended position.

Although various means can be used to attach the resilient element to the tubes, such means may include a fastener member engaging one end of the inner tube in the collapsed position and having the resilient element affixed thereto. The fastener element may have a flange which engages the outer tube when the tubes are moved from the collapsed position toward the extended position. In this manner, the outer tube "picks up" the fastener member and stretches the resilient element as the tubes are moved axially apart.

Thus, the fastener member can serve two functions, i.e., attachment of the resilient element to the inner tube and as a pickup for temporary attachment to the outer tube. This construction is also inexpensive and easy to assemble.

The tubes are preferably relatively axially rotatable. This permits the wrists to be exercised while an outward pulling force is being exerted on the tubes.

Means is provided for preventing separation of the tubes in either direction. Although such means may take different forms, the tubes can be prevented from being pulled apart generally axially beyond the extended position by cooperating internal and external shoulders on the outer and inner tubes, respectively. By closing one end of the outer tube, movement of the tubes axially inwardly beyond the collapsed position can be prevented.

Although the elongated flexible element may include a coil spring constructed of metal, it is preferably in the form of a resilient, non-metallic cord or tube, such as a rubber tube. By using a rubber resilient element, there is no sound created from pulling on the resilient element, and there is no sound made if the resilient element contacts the interior wall of one of the tubes.

The tubes perform several important functions. For example, they accurately guide the pulling motion. The tubes also house the resilient element to protect it from cuts and from the elements which may tend to deteriorate the resilient element. This extends the life of the resilient element. The tubes also serve to mount various components of the exercising device, including the shoulders which prevent movement of the tubes axially beyond the extended position.

To facilitate pulling the tubes apart, hand grips are preferably provided on one end of the inner tube and the opposite end of the outer tube. These hand grips can perform other desirable functions. For example, the hand grips may include end walls which close the outer ends of the inner and outer tubes. This not only covers the attachment members which attach the resilient element to the tubes, but the end wall on the hand grip of the outer tube prevents inward movement of the inner tube beyond the collapsed position. Thus, the hand grips perform functions not characteristically performed by hand grips.

The hand grip on the inner tube has a pheripheral wall which terminates in an end face which confronts one end of the outer tube. Preferably, the end face and such confronting end of the outer tube are separated sufficiently in the collapsed position to avoid pinching the user's hand as the tubes are resiliently drawn toward the collapsed position by the resilient element.

The invention, together with further features and advantages thereof, may best be understood by reference to the following description taken in connection with the accompanying illustrative drawing.

DESCRIPTION OF THE PREFERRED EMBODIMENT

Figures 1, 2, 3, 4, 5:
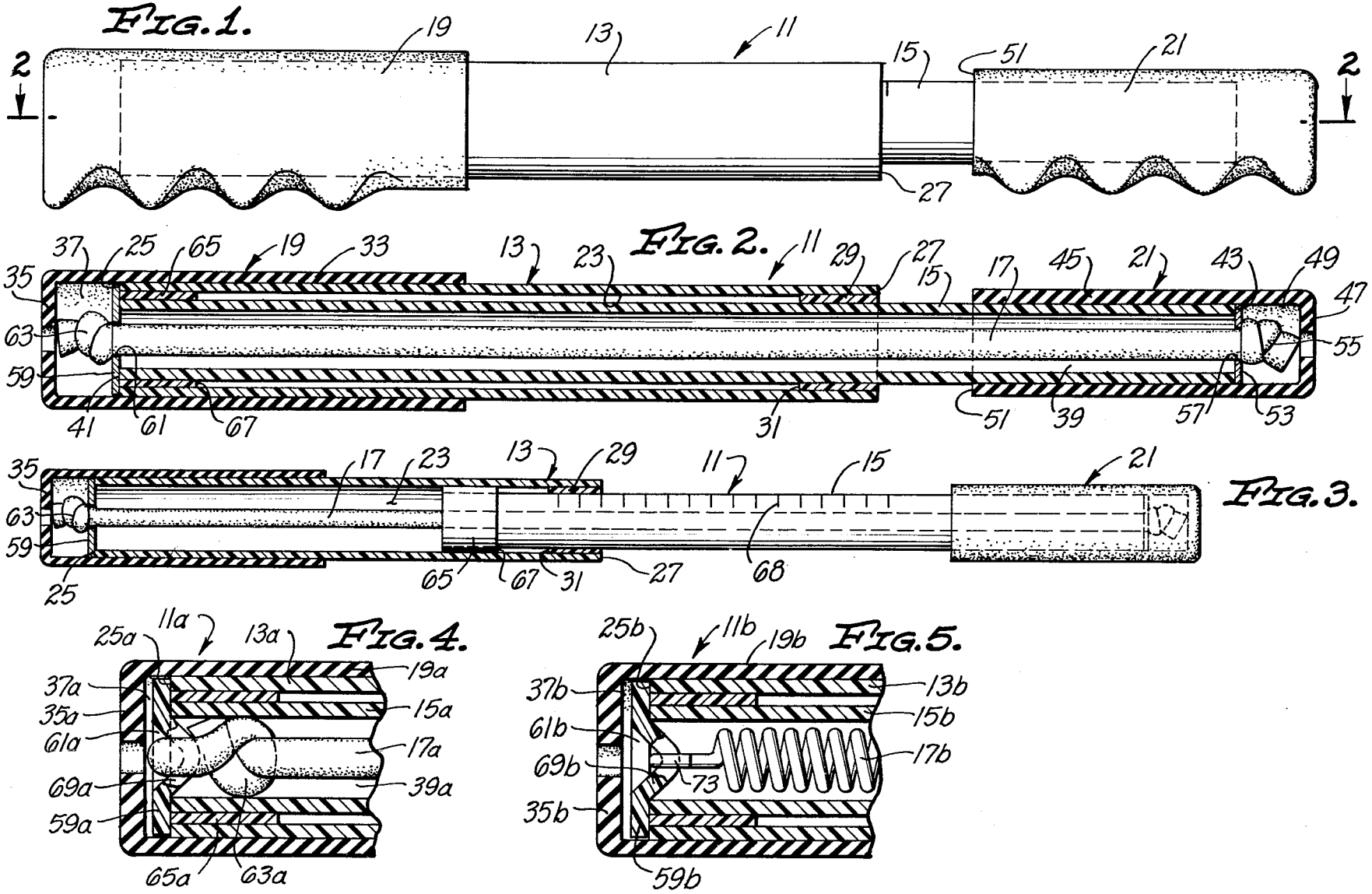
FIG. 1 is an elevational view of an exercising device constructed in accordance with the teachings of this invention.
FIG. 2 is a sectional view taken generally along line 2—2 of FIG. 1 with the exercising device in the collapsed position.
FIG. 3 is a view similar to FIG. 2 on a reduced scale with the inner tube and associated hand grip being shown in elevation and with the tubes being pulled toward the extended position.
FIG. 4 is an enlarged fragmentary sectional view illustrating a modification of the exercising device.
FIG. 5 is an enlarged fragmentary sectional view illustrating another modification of the exercising device.

FIGS. 1-3 show an exercising device 11 which generally includes an outer tube 13, an inner tube 15, a resilient element 17, and hand grips 19 and 21 on the outer and inner tubes, respectively. Although the tubes 13 and 15 may be of various different constructions, in the embodiment illustrated, each of these tubes is cylindrical and constructed of a rigid plastic material, such as polyvinyl chloride. The outer tube 13 has a cylindrical passage 23 extending axially therethrough and opposite annular end faces 25 and 27. A collar or bushing 29 of plastic or other material is fixedly mounted within the passage 23 adjacent the end face 27. The bushing 29 may be affixed to the tube 13 in any suitable manner, such as by an adhesive. The bushing 29 defines an internal annular shoulder 31 with the shoulder also being adjacent the end face 27. The other or outer end of the tube 13 serves to mount the hand grip 19.

The hand grip 19 has a peripheral wall 33 which tightly surrounds and grips the tube 13 to mount the hand grip on the tube. The hand grip 19 also includes an end wall 35 which substantially closes the outer end of the outer tube 13. The end wall 35 is axially spaced from the end face 25 as shown in FIGS. 2 and 3 to define a gap 37.

The inner tube 15 has a cylindrical passage 39 extending axially therethrough and opposite annular end faces 41 and 43. The inner tube 15 is longer than the outer tube 13 and is telescoped within the outer tube. The outer end of the inner tube 15 mounts the hand grip 21. The hand grip 21, like the hand grip 19, includes a peripheral wall 45 and an end wall 47 spaced from the end face 43 to define a gap 49. The peripheral wall 45 surrounds the outer end portion on the inner tube 15 to mount the hand grip 21 on the inner tube, and the end wall 47 substantially encloses the outer end of the inner tube. The peripheral wall 45 terminates in an annular end face 51 which is separated from the end face 27 as shown in FIGS. 1 and 2.

Although the resilient element 17 may take different forms, in the embodiment illustrated, it is in the form of rubber tubing. The resilient element 17 extends axially completely through the passage 39 of the inner tube 15.

Means is provided for attaching the resilient element 17 to the outer end of the inner tube 15. Although such means may take different forms, in the embodiment illustrated, it includes a fastener member in the form of a washer 53 and an enlargement in the form of a knot 55 on the resilient element 17. The resilient element 17 extends through a central aperture 57 in the washer 53, and the knot 55 lies axially outwardly of the washer in the gap 49. The washer 53 is resiliently held against the end face 43 by the resilient element 17 and need not be otherwise attached to the inner tube 15.

The other end of the resilient element 17 is similarly attached to the opposite end of the inner tube 15 by a fastener member in the form of a washer 59 having an aperture 61 therein and a knot 63 in the gap 37.

The resilient element 17 is prestressed between the washers 53 and 59 with the magnitude of such prestress being dependent upon the resistance to initial pull that is desired. The washer 59 is of larger diameter than the washer 53 and extends radially over the end face 25 of the outer tube 13. The outer peripheral region of the washer 59 may be considered as a flange which projects into the path of the movement of the outer tube 13.

A bushing 65 of plastic or other material is attached as by an adhesive to the end of the inner tube 15 adjacent the end face 41. The bushing 65 provides an internal annular shoulder 67. The bushings 29 and 65 coaxially mount the tubes 13 and 15 for relative axial movement and relative rotational movement about their axes.

The resilient element 17 normally holds the tubes 13 and 15 in the collapsed position. The end wall 35 prevents movement of the outer tube 13 to the right of the position shown in FIGS. 1 and 2.

In use of the exercising device 11, the user manually grasps the hand grips 19 and 21 and pulls axially outwardly on the tubes 13 and 15. The tubes 13 and 15 will not begin movement toward the extended position until the user exerts a force of a magnitude slightly greater than the magnitude of the prestress or preload on the resilient element 17. Once this force level has been reached, the tubes 13 and 15 begin axial movememt toward the extended position as shown in FIG. 3. As the tubes 13 and 15 being moving apart, the end face 25 engages the outer peripheral region of the washer 59 to remove the washer from engagement with the end face 41 of the inner tube 15. In this manner, the resilient element 17 becomes attached to the outer tube 13 when the tubes are pulled from the collapsed position toward the extended position. As the pulling force increases, the tubes 13 and 15 are moved toward the extended position. If a sufficient pulling force is exerted on the tubes 13 and 15, the extended position is reached in which the shoulders 31 and 67 are in engagement to prevent further axial separation of the tubes. The shoulders 31 and 67 also prevent separation of the tubes 13 and 15 in the event that the resilient element 17 should break.

If for any reason the user should let go of one or both of the hand grips 19 and 21, the resilient element 17 would propel the tubes very rapidly toward the collapsed position. The end wall 35 of the hand grip 19 closes the outer end of the outer tube 13 sufficiently to prevent the inner tube 15 from moving axially inwardly beyond the collapsed position and shooting out the end of the outer tube. Also, the hand grip 21 is of larger diameter than the passage through the bushing 29 and so this hand grip serves as a safety backup in this regard. Because of the spacing of the end faces 27 and 51 in the collapsed position, it is extremely unlikely that the hand of the user would be pinched between these two end faces even if the exercising device 11 should be inadvertently and rapidly moved to the collapsed position.

Indicia 68 may be provided on the inner tube 15 to indicate to the user the degree to which the tubes 13 and 15 have been moved toward the extended position. At any time during the movement of the tubes to the extended position, the tubes may be relatively axially rotated to exercise the wrists of the user.

FIG. 4 shows an exercising device 11*a* which is identical to the exercising device 11 in all respects, except for the configuration of the washer 59*a*, the reduction in size of the gap 37*a* and the placement of the knot 63*a* within the inner tube 15*a* in lieu of within the gap 37*a*. Portions of the exercising device 11*a* corresponding to portions of the exercising device 11 are designated by corresponding reference numerals followed by the letter "a." The washer 59*a* has an integral V-shaped projection 69*a* extending across the aperture 61*a* and projecting into the passage 39*a*. The resilient element 17*a* is passed through the aperture 61*a* and wrapped around the V-shaped projection 69*a*. The knot 63*a* is the passage 39*a*. The operation of the exercising device 11*a* is identical to the operation of the exercising device 11.

FIG. 5 shows an exercising device 11*b* which is identical to the exercising device 11*a*, except that the resilient element 17*b* is in the form of a coil compression spring constructed of metal. Portions of the exercising device 11*b* corresponding to portions of the exercising device 11*a* are designated by corresponding reference numerals with the letter "b" substituted for the letter "a." The coil compression spring 17*b* has a hook 73 which is wrapped at least part way around the V-shaped projection 69*b* to attach the spring to the washer 59*b*. The hook 73 replaces the knot 63*a*.

Although exemplary embodiments of the invention have been shown and described, many changes, modifications and substitutions may be made by one having ordinary skill in the art without necessarily departing from the spirit and scope of this invention.

I claim:

1. An exercising device comprising:

outer and inner tubes, each of said tubes having a first end portion and a second end portion, said inner tube being at least partially within said outer tube, said tubes being capable of being manually grasped and pulled generally axially from a collapsed position to an extended position;

means for preventing said tubes from being pulled generally axially apart beyond said extended position;

an elongated resilient element extending at least part way through the inner member;

first means for attaching the elongated resilient element to said inner tube adjacent the first end portion thereof;

releasable means for attaching the elongated resilient element to the inner tube adjacent the second end portion thereof at least when said tubes are in the collapsed position; and said releasable means including means responsive to movement of said tubes from the collapsed position toward the extended position for releasing the elongated resilient element from the second end portion of said inner tube and attaching the elongated resilient element to the outer tube adjacent the second end portion thereof whereby the elongated resilient element can be forcibly resiliently elongated in pulling said tubes from the collapsed position to the extended position and can resist the movement of said tubes from the collapsed position to the extended position.

2. An exercising device as defined in claim 1 wherein said elongated resilient element resiliently holds the tubes in the collapsed position and is prestressed in the collapsed position whereby a pulling force of a predetermined magnitude must be exerted on said tubes before said tubes can commence movement from the collapsed position toward the extended position.

3. An exercising device as defined in claim 2 wherein said tubes are relatively axially rotatable whereby the wrists can be exercised.

4. An exercising device as defined in claim 2 including a hand grip on said first end portion of said inner tube and a hand grip on said second end portion of said outer tube, each of said hand grips including a peripheral wall on the associated tube and an end wall.

5. An exercising device as defined in claim 2 including means for preventing the tubes from moving generally axially inwardly beyond the collapsed position, said exercising device including a hand grip on said first end portion of said inner tube and a hand grip on said second end portion of said outer tube, said first end portion of said outer tube terminating in a first end, said hand grip on said inner tube including a peripheral wall terminating in an end face spaced from said first end of said outer tube to prevent the fingers of the user from being pinched between said end face and said first end of the outer tube.

6. An exercising device as defined in claim 2 wherein said elongated resilient element is constructed in substantial part of rubber.

7. An exercising device as defined in claim 2 wherein said preventing means includes an interior shoulder within the first end portion of said outer tube and an external shoulder on the exterior of said second end portion of said inner tube, said shoulders being engageable in said extended position.

* * * * *